US011084140B2

(12) United States Patent
Tchakarov

(10) Patent No.: US 11,084,140 B2
(45) **Date of Patent: *Aug. 10, 2021**

(54) METHOD OF USING POLISHING OR GRINDING PAD ASSEMBLY

(71) Applicant: Husqvarna AB, Huskvarna (SE)

(72) Inventor: Tchavdar V. Tchakarov, Monroe, MI (US)

(73) Assignee: HUSQVARNA AB, Huskvarna (SE)

( * ) Notice: Subject to any disclaimer, the term of this patent is extended or adjusted under 35 U.S.C. 154(b) by 0 days.

This patent is subject to a terminal disclaimer.

(21) Appl. No.: 16/718,641

(22) Filed: Dec. 18, 2019

(65) Prior Publication Data

US 2020/0121154 A1 Apr. 23, 2020

Related U.S. Application Data

(60) Continuation of application No. 16/274,624, filed on Feb. 13, 2019, now Pat. No. 10,667,665, which is a (Continued)

(51) Int. Cl.
*B24B 7/18* (2006.01)
*B24B 7/22* (2006.01)

(Continued)

(52) U.S. Cl.
CPC ..... *B24B 7/186* (2013.01); *A47L 11/164* (2013.01); *A47L 11/4038* (2013.01); *B24B 7/18* (2013.01);

(Continued)

(58) Field of Classification Search
CPC .. B24B 7/18; B24B 7/186; B24B 7/22; B24B 41/047; B24B 41/0475; B24D 11/00;

(Continued)

(56) References Cited

U.S. PATENT DOCUMENTS 2,174,902 A 10/1939 Stratford
2,225,193 A 12/1940 Benner et al.

(Continued)

FOREIGN PATENT DOCUMENTS

CA 159666 S 7/2015
CA 162792 S 7/2015

(Continued)

OTHER PUBLICATIONS

"Confidential/experimental sale from Diamond Tool Supply, Inc. to Wagman Metal Products on Sep. 1, 2016," 2 pages.

(Continued)

*Primary Examiner* — Eileen P Morgan
(74) *Attorney, Agent, or Firm* — Burr & Forman, LLP

(57) ABSTRACT

A floor polishing or grinding pad assembly is provided. In one aspect, a polishing or grinding pad assembly employs a fibrous pad, a reinforcement layer or ring, and multiple floor-contacting disks. In another aspect, the reinforcement layer includes a central hole through which the fibrous pad is accessible and the fibrous pad at the hole has a linear dimension greater than a linear dimension of one side of the adjacent reinforcement layer. In yet another aspect, at least one of the floor-contacting disks has an angle offset from that of a base surface of the disk, the fibrous pad and/or the reinforcement layer. A further aspect employs a smaller set of disks alternating between and/or offset from a larger set of the disks. In another aspect, the reinforcement layer includes a wavy or undulating internal edge shape.

13 Claims, 14 Drawing Sheets

Related U.S. Application Data division of application No. 15/927,560, filed on Mar. 21, 2018, now Pat. No. 10,244,914, which is a continuation of application No. PCT/US2016/053355, filed on Sep. 23, 2016.

(60) Provisional application No. 62/232,123, filed on Sep. 24, 2015.

(51) Int. Cl.

| | |
|---|---|
| ***B24B 41/047*** | (2006.01) |
| ***B24D 7/08*** | (2006.01) |
| ***B24D 13/14*** | (2006.01) |
| ***B24D 11/00*** | (2006.01) |
| ***B24D 18/00*** | (2006.01) |
| ***A47L 11/164*** | (2006.01) |
| ***A47L 11/40*** | (2006.01) |
| ***B24D 7/06*** | (2006.01) |

(52) U.S. Cl.

CPC ..... *B24B 7/22* (2013.01); *B24B 41/047* (2013.01); *B24B 41/0475* (2013.01); *B24D 7/066* (2013.01); *B24D 7/08* (2013.01); *B24D 11/00* (2013.01); *B24D 13/14* (2013.01); *B24D 18/0072* (2013.01)

(58) Field of Classification Search

CPC ..... B24D 13/14; B24D 7/066; B24D 7/08; B24D 18/0072

USPC ..... 451/353

See application file for complete search history.

(56) References Cited

U.S. PATENT DOCUMENTS 2,425,368 A 8/1947 Doermann
2,556,983 A 6/1951 Root
2,662,454 A 12/1953 Whiteman
2,819,568 A 1/1958 Kasick
2,963,059 A 12/1960 Grub
3,121,982 A 2/1964 Miller
3,452,381 A 7/1969 Bratti
3,464,166 A 9/1969 Bouvier
3,487,589 A 1/1970 Binkley
3,517,466 A 6/1970 Bouvier
3,591,884 A 7/1971 Grueb
3,686,703 A 8/1972 Ray
3,823,516 A 7/1974 Christian
3,934,377 A 1/1976 Tertinek
4,058,936 A 11/1977 Marton
4,271,557 A 6/1981 Caron
4,502,174 A 3/1985 Rones
4,554,765 A 11/1985 Grimes et al.
D284,969 S 8/1986 Olovsson
4,694,615 A 9/1987 MacKay, Jr.
4,724,567 A 2/1988 Rones
4,781,556 A 11/1988 Paul
4,874,478 A 10/1989 Ishak et al.
4,939,872 A 7/1990 Revelin et al.
5,020,280 A 6/1991 O'Reilly
5,054,245 A 10/1991 Coty
5,076,023 A 12/1991 Saguchi
5,170,595 A 12/1992 Wiand
5,174,795 A 12/1992 Wiand
5,247,765 A * 9/1993 Quintana ..... B24D 7/063 451/548
5,372,452 A 12/1994 Hodgson
5,449,406 A 9/1995 Presti, Jr.
5,452,853 A 9/1995 Shook et al.
5,477,580 A 12/1995 Buysse
D367,743 S 3/1996 Krause et al.
5,567,503 A 10/1996 Sexton et al.
5,586,930 A 12/1996 Hayashi et al.
5,605,493 A 2/1997 Donatelli et al.
5,607,345 A 3/1997 Barry et al.
5,632,570 A 5/1997 Balling
5,632,790 A 5/1997 Wiand
5,683,143 A 11/1997 Peterson et al.
5,782,682 A 7/1998 Han et al.
5,807,022 A 9/1998 McCleary
5,882,249 A 3/1999 Ferland
5,970,559 A 10/1999 Christy
6,059,644 A 5/2000 Manor et al.
6,196,911 B1 3/2001 Preston et al.
6,206,771 B1 3/2001 Lehman
6,234,886 B1 5/2001 Rivard et al.
6,261,164 B1 * 7/2001 Rivard ..... A47L 11/164 451/353
6,298,518 B1 10/2001 Umbrell
6,299,522 B1 10/2001 Lee
6,371,842 B1 4/2002 Romero
6,382,922 B1 5/2002 Lewis et al.
6,536,989 B2 3/2003 Rijkers
6,625,951 B1 9/2003 McCarthy
6,641,627 B2 11/2003 Keipert et al.
6,739,963 B1 5/2004 Mas Garcia
6,830,506 B2 12/2004 Catalfamo
D503,602 S 4/2005 Hede
D506,376 S 6/2005 Hede
D509,121 S 9/2005 Hede
D510,850 S 10/2005 Boler, Jr.
6,971,821 B1 12/2005 Mansour et al.
7,004,676 B2 2/2006 Williams
7,033,258 B2 4/2006 Jordan
7,059,801 B2 6/2006 Snyder et al.
7,094,138 B2 8/2006 Chang
7,104,739 B2 9/2006 Lagler
7,144,194 B2 12/2006 Kipp, Jr.
7,147,548 B1 12/2006 Mehrabi
7,172,365 B2 2/2007 Lutz et al.
7,192,339 B1 3/2007 Harding
7,204,745 B2 4/2007 Thysell
7,223,161 B2 5/2007 Kodani et al.
7,261,623 B1 8/2007 Palushi
D559,063 S 1/2008 Okamoto et al.
7,326,106 B1 2/2008 Rogers et al.
D576,855 S 9/2008 Okamoto et al.
D580,728 S 11/2008 Umbrell
D581,237 S 11/2008 Okamoto et al.
D584,591 S 1/2009 Tano et al.
7,481,602 B2 1/2009 Lampley et al.
7,506,644 B2 3/2009 Park
7,520,800 B2 4/2009 Duescher
D592,029 S 5/2009 Tano et al.
D592,030 S 5/2009 Tano et al.
D600,989 S 9/2009 Tano et al.
D612,874 S 3/2010 Nilsson et al.
7,670,208 B2 3/2010 Thysell et al.
7,674,069 B2 3/2010 Stenzel
7,690,970 B2 4/2010 Palushaj
7,713,109 B2 5/2010 Estes
7,744,447 B2 * 6/2010 Kodani ..... B24D 7/06 451/548
7,815,393 B2 10/2010 Snyder et al.
7,997,960 B2 8/2011 Williams, Sr.
D657,404 S 4/2012 Brandstetter
8,147,297 B2 4/2012 Hamm et al.
8,176,909 B2 5/2012 Ilgner
8,192,255 B2 6/2012 Gallup et al.
8,251,780 B2 8/2012 Ward et al.
8,272,924 B2 9/2012 Van Eijden et al.
D678,745 S 3/2013 Nguyen
8,464,420 B2 6/2013 Ye
D694,081 S 11/2013 Wright
D708,497 S 7/2014 Hoglund
8,790,164 B2 7/2014 Rivard et al.
D731,448 S 6/2015 Kinoshita et al.
D732,917 S 6/2015 Valentini
9,050,625 B1 6/2015 Bonachea Ruiz
D743,456 S 11/2015 Shinozaki et al.
9,174,326 B2 11/2015 Ahonen
9,314,899 B2 4/2016 Puchegger et al.

(56) References Cited

U.S. PATENT DOCUMENTS

| | | | | |
|---|---|---|---|---|
| 9,580,916 | B2 | 2/2017 | Tchakarov et al. | |
| D795,666 | S | 8/2017 | Tchakarov et al. | |
| 9,925,645 | B2 | 3/2018 | Song et al. | |
| 10,011,999 | B2 | 7/2018 | Tchakarov et al. | |
| 10,046,438 | B2 | 8/2018 | Tchakarov | |
| 10,092,159 | B2 | 10/2018 | Tchakarov | |
| D837,015 | S | 1/2019 | Tchakarov et al. | |
| 10,244,914 | B2 * | 4/2019 | Tchakarov | B24D 11/00 |
| 10,246,885 | B2 | 4/2019 | Tchakarov | |
| 2001/0048854 | A1 | 12/2001 | Carter, Jr. | |
| 2003/0029132 | A1 | 2/2003 | Ward | |
| 2004/0009744 | A1 | 1/2004 | Conley et al. | |
| 2005/0164620 | A1 | 7/2005 | Amamoto | |
| 2005/0172428 | A1 | 8/2005 | Thysell | |
| 2005/0227600 | A1 | 10/2005 | Fisher | |
| 2006/0025059 | A1 | 2/2006 | Gueorguiev et al. | |
| 2006/0073776 | A1 | 4/2006 | Gallup | |
| 2006/0211353 | A1 | 9/2006 | Kodani et al. | |
| 2007/0254568 | A1 * | 11/2007 | Park | B24B 41/047 451/548 |
| 2007/0292207 | A1 | 12/2007 | Reed et al. | |
| 2008/0108286 | A1 | 5/2008 | Thysell et al. | |
| 2008/0176498 | A1 | 7/2008 | Rossi et al. | |
| 2008/0311826 | A1 | 12/2008 | Thysell | |
| 2009/0053982 | A1 | 2/2009 | Popov | |
| 2009/0190999 | A1 | 7/2009 | Copoulos | |
| 2009/0191799 | A1 | 7/2009 | Rivard | |
| 2010/0136889 | A1 | 6/2010 | Kilgren et al. | |
| 2010/0190421 | A1 | 7/2010 | Hamm et al. | |
| 2010/0240282 | A1 | 9/2010 | Young | |
| 2011/0053468 | A1 | 3/2011 | Vontell | |
| 2011/0092136 | A1 | 4/2011 | Thysell | |
| 2011/0195644 | A1 | 8/2011 | Gallup et al. | |
| 2011/0222966 | A1 | 9/2011 | Allen et al. | |
| 2011/0223845 | A1 | 9/2011 | Van Der Veen et al. | |
| 2011/0300784 | A1 | 12/2011 | Tchakaov et al. | |
| 2012/0270483 | A1 | 10/2012 | Bae et al. | |
| 2013/0000246 | A1 | 1/2013 | Bourelle | |
| 2013/0225051 | A1 | 8/2013 | Vankouenberg | |
| 2013/0324021 | A1 | 12/2013 | Ryan | |
| 2014/0154961 | A1 | 6/2014 | Fiore | |
| 2015/0328742 | A1 | 11/2015 | Schuele et al. | |
| 2016/0083967 | A1 | 3/2016 | Tchakarov et al. | |
| 2016/0136772 | A1 | 5/2016 | Littlefield et al. | |
| 2016/0144485 | A1 | 5/2016 | Ruan et al. | |
| 2016/0221155 | A1 | 8/2016 | Song et al. | |
| 2017/0129067 | A1 | 5/2017 | Young | |
| 2017/0361414 | A1 | 12/2017 | Tchakarov | |
| 2017/0361423 | A1 | 12/2017 | Tchakarov | |
| 2018/0200857 | A1 | 7/2018 | Tchakarov | |
| 2018/0206690 | A1 | 7/2018 | Tchakarov | |

FOREIGN PATENT DOCUMENTS

| | | | |
|---|---|---|---|
| CA | 162793 | S | 7/2015 |
| CA | 162794 | S | 7/2015 |
| CA | 162795 | S | 7/2015 |
| CA | 162796 | S | 7/2015 |
| CA | 162797 | S | 7/2015 |
| DE | 20120137 | U1 | 2/2002 |
| DE | 102009008261 | A1 | 8/2010 |
| DE | 202015101442 | U1 | 5/2015 |
| EP | 3 348 352 | A1 | 7/2018 |
| JP | S49-77293 | U | 7/1974 |
| JP | S56-94267 | U | 7/1981 |
| JP | H01-117854 | U | 8/1989 |
| JP | 2001-526593 | A | 12/2001 |
| JP | 2004-025401 | A | 1/2004 |
| JP | 2004-276197 | A | 10/2004 |
| JP | 2006068885 | A | 3/2006 |
| JP | 2008-532781 | A | 8/2008 |
| JP | 2012-232378 | A | 11/2012 |
| JP | 2014-513635 | A | 6/2014 |
| KR | 100816026 | B1 | 3/2008 |
| KR | 100853547 | B1 | 8/2008 |
| WO | 2008/065210 | A1 | 6/2008 |
| WO | 2017/053737 | A1 | 3/2017 |

OTHER PUBLICATIONS

"Diamond Tools for Construction Stone," EHWA Diamond Ind. Co. Ltd. Catalogue, Published 2016, 60 pages.

Diamond Tool Supply, Inc., "Floor Maintenance and Cleaning—Monroe" Catalog, (published prior to Sep. 2014).

Diamond Tool Supply, Inc., "Floor Maintenance and Cleaning—Vortex" Catalog, (published on or before May 2013).

Diamond Tool Supply, Inc., "Monroe Floor Polishing Systems," www.diamondtoolsupply.com, published prior to Sep. 24, 2015, 14 pages.

Diamond Tool Supply, Inc., "Tools for Concrete" Catalog, (published on or before May 2013).

Diamond Tool Supply, Inc., "Tools for Concrete" Catalog, (published prior to Sep. 2014).

Diamond Tool Supply, Inc., "Tools for Stone" Catalog, (published prior to Sep. 2014).

Diamond Tool Supply, Inc., Various polishing and grinding parts, www.diamondtoolsupply.com, published prior to Sep. 24, 2015, 26 pages.

HTC, "Professional Floor Systems" Product catalog 2014, www.htc-floorsystems.com, 2014.

HTC, "Professional Floor Systems" Product catalogue 2015, www.htc-floorsystems.com, 2015.

Si GmbH, The System Manufacturer, Brochure Edition Jan. 12, 2017, 83 pages.

Wagman Metal Products Inc., "Concrete Finishing Tools" Catalog, (published prior to Sep. 23, 2016).

International Search Report and Written Opinion for International Application No. PCT/US2016/053355 dated Dec. 22, 2016.

International Search Report and Written Opinion for International Application No. PCT/US2018/048845 dated Dec. 5, 2018.

International Preliminary Report on Patentability for International Application No. PCT/US2016/053355 dated Mar. 27, 2018.

* cited by examiner

METHOD OF USING POLISHING OR GRINDING PAD ASSEMBLY

CROSS-REFERENCE TO RELATED APPLICATIONS

This application is a divisional of U.S. patent application Ser. No. 15/927,560, filed Mar. 21, 2018, which is a Continuation of PCT Patent Application Serial No. PCT/US2016/053355, filed Sep. 23, 2016, which claims priority to U.S. Provisional Patent Application Ser. No. 62/232,123, filed on Sep. 24, 2015, all of which are incorporated by reference herein.

BACKGROUND AND SUMMARY

The disclosure relates generally to a pad assembly and more particularly to a floor polishing or grinding pad assembly.

It is known to use fibrous pads for polishing and grinding floors within industrial or commercial buildings. Such polishing or grinding pads are ideally suited for use on concrete, terrazzo, and natural (e.g., marble), engineered and composite stone floors. Examples of such pads and the powered machines used to rotate such can be found in the following U.S. patents and patent publication numbers: 2011/0300784 entitled "Flexible and Interchangeable Multi-Head Floor Polishing Disk Assembly" which was invented by Tchakarov et al. and published on Dec. 8, 2011; U.S. Pat. No. 9,174,326 entitled "Arrangement For Floor Grinding" which issued to Ahonen on Nov. 3, 2015; U.S. Pat. No. 6,234,886 entitled "Multiple Abrasive Assembly and Method" which issued to Rivard et al. on May 22, 2001; U.S. Pat. No. 5,605,493 entitled "Stone Polishing Apparatus and Method" which issued to Donatelli et al. on Feb. 25, 1997; and U.S. Pat. No. 5,054,245 entitled "Combination of Cleaning Pads, Cleaning Pad Mounting Members and a Base Member for a Rotary Cleaning Machine" which issued to Coty on Oct. 8, 1991. All of these patents and the patent publication are incorporated by reference herein.

Notwithstanding, improved floor polishing and grinding performance is desired. Furthermore, some of these prior constructions exhibit uneven wear in use which prematurely destroy the pads or cause inconsistent polishing or grinding.

In accordance with the present invention, a floor polishing or grinding pad assembly is provided. In one aspect, a polishing or grinding pad assembly employs a fibrous pad, a reinforcement layer or ring, and multiple floor-contacting disks. In another aspect, the reinforcement layer includes a central hole through which the fibrous pad is accessible and the fibrous pad at the hole has a linear dimension greater than a linear dimension of one side of the adjacent reinforcement layer. In yet another aspect, at least one of the floor-contacting disks has an angle offset from that of a base surface of the disk, the fibrous pad and/or the reinforcement layer. A further aspect employs a smaller set of disks alternating between and/or offset from a larger set of the disks. In another aspect, the reinforcement layer includes a wavy or undulating internal edge shape. Still another aspect includes different abrasive and/or floor-contacting patterns on the disks. A method of using a fibrous pad employing multiple polishing or grinding disks is also presented.

The present pad assembly is advantageous over traditional devices. For example, some of the disk configurations, such as disk angles and/or offset placement of disks, of the present pad assembly advantageously create more consistent wear characteristics when polishing or grinding, thereby increasing their useful life and consistency of polishing or grinding. These angles cause more even inner and outer wear of the floor-facing side of the pad assembly. Furthermore, the present pad assembly advantageously allows greater floor contact with the fibrous pad within a centralized area generally surrounded by the disks, in various of the present aspects, which is expected to improve polishing or grinding performance. In other configurations of the present pad assembly, the disk patterns, disk quantities, disk-to-disk locations and inner edge shapes of the reinforcement layer may provide improved liquid abrasive flow characteristics during polishing or grinding. The preassembled nature of the fibrous pad, reinforcement ring or layer, and the abrasive disks makes the present pad assembly considerably easier to install on a floor polishing or grinding machine than many prior constructions. Additional advantages and features of the present invention will be readily understood from the following description, claims and appended drawings.

DETAILED DESCRIPTION

Figure 1:
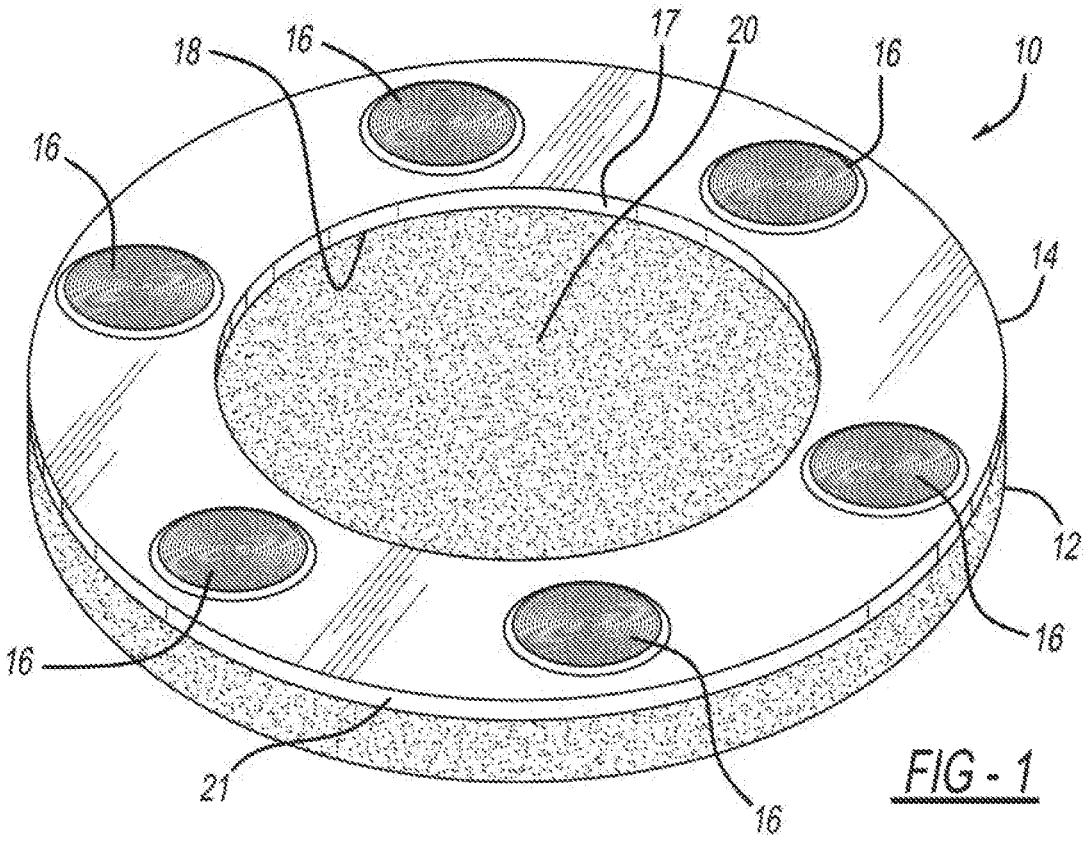
FIG. 1 is a bottom perspective view showing a first embodiment of the pad assembly.

A pad assembly 10 according to one embodiment is shown in FIGS. 1-5. Pad assembly 10 may be used for grinding or polishing composite surfaces, such as concrete. Pad assembly 10 includes a wear-resistant base pad 12, which may be a porous, fibrous, flexible, and deformable material, including natural and/or artificial fibers. Base pad 12 is generally circular, having a diameter and a thickness. Of course, base pad 12 could be made in other sizes.

A reinforcement ring or layer 14 is secured to one side of base pad 12, such as by adhesive. The reinforcement ring 14 is generally annular having a central opening 18 with a diameter (for example, approximately 8 inches). Reinforcement ring 14 may be a rigid rubber or plastic having a thickness greater than zero and up to 0.125 inch. Reinforcement ring or layer 14 reinforces and adds some stiffness and toughness to the outer portion of pad 12, however, ring or layer 14 allows some flexibility to pad assembly 10 so it can flex with and follow any floor imperfections thereby producing uniform floor contact for polishing or grinding.

A circular internal edge 17 of reinforcement ring 14 defines a central opening or hole 18 which exposes a central surface 20 of base pad 12. Central surface 20 of base pad 12 may be impregnated with diamond particles or other abrasive materials. Central surface 20 of the base pad 12 may also be painted a color indicating a quality of the pad assembly 10, such as the coarseness. Base pad 12 and ring 14 preferably have circular peripheral surfaces 19 and 21, respectively.

A plurality of abrasive tools or floor-contacting disks 16 are secured to the outer surface of the reinforcement ring 14. In the example shown, abrasive tools 16 are approximately 2 inch disks of diamond particles in a polymeric resin matrix. In the example shown, six such abrasive tools or disks 16 are secured about the circumference of reinforcement ring 14. Different sizes and different compositions of abrasive tools or disks 16 could be used. Tools or disks 16 are adhesively bonded to ring 14.

Figure 2:
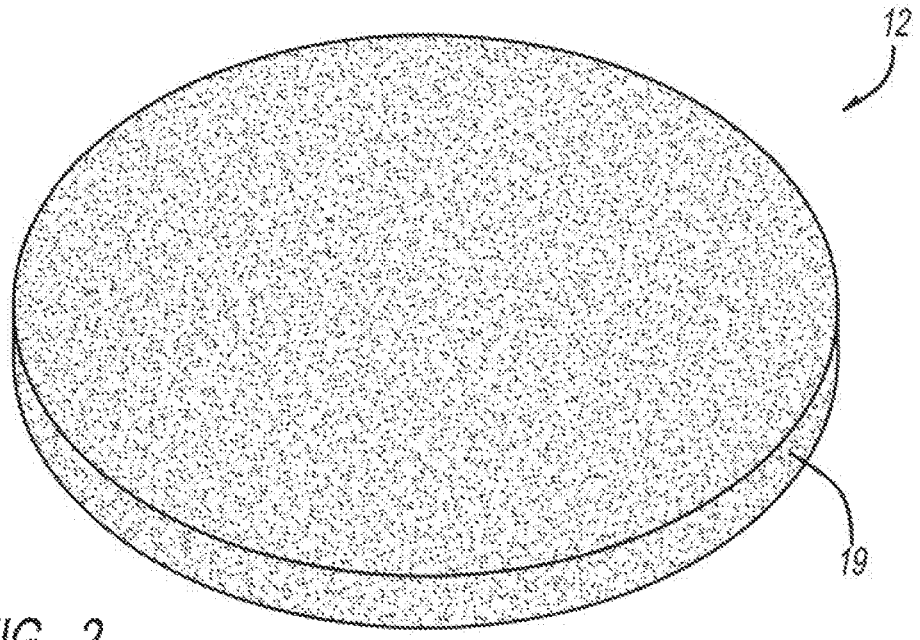
FIG. 2 is a top perspective view showing a fibrous pad employed in all embodiments of the pad assembly.

FIG. 2 shows base pad 12. Again, different base pads 12 could be used, but the example shown is a wear-resistant base pad 12 having a diameter of approximately 14 inches and a thickness of approximately one inch.

Figure 3:
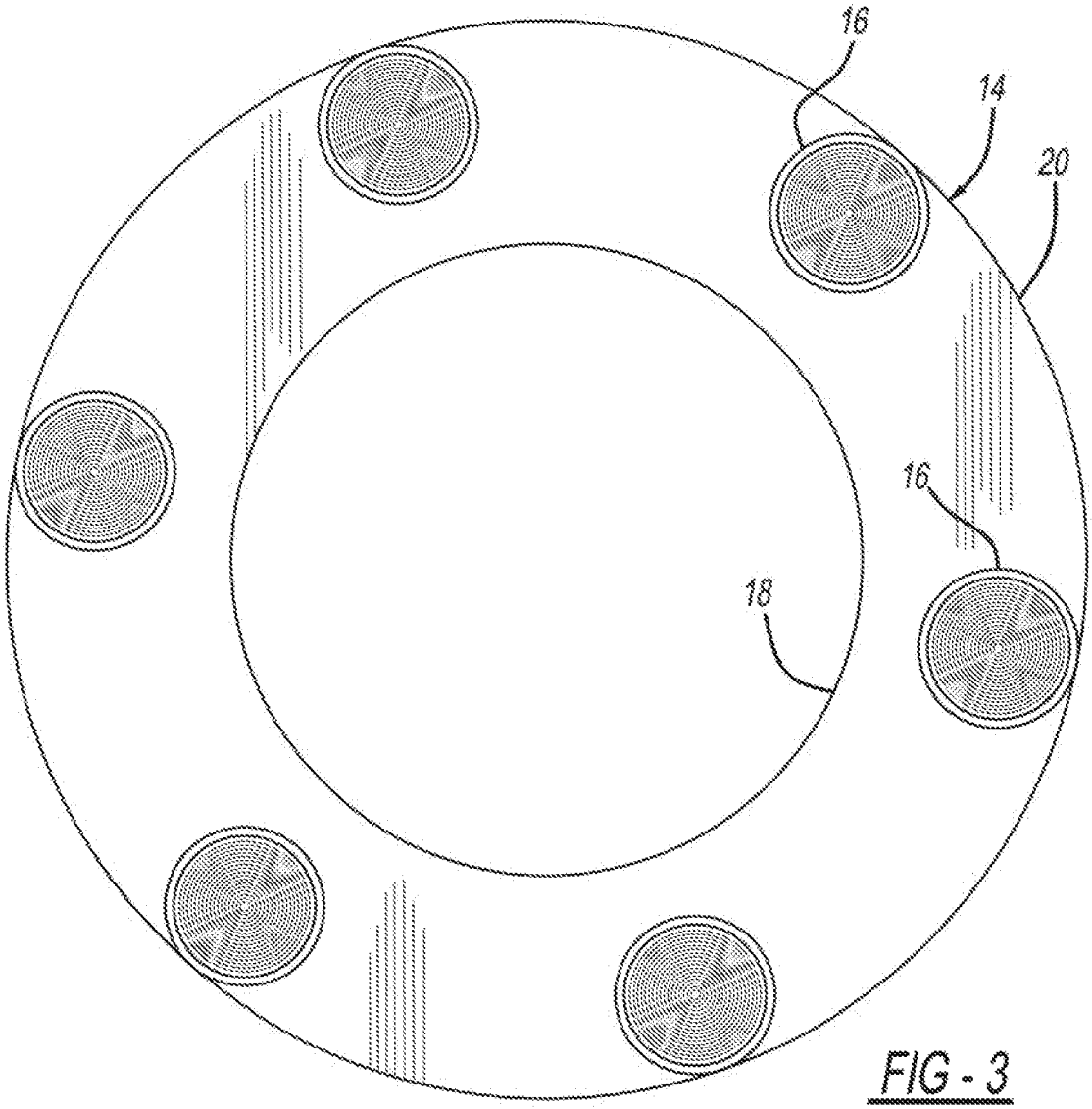
FIG. 3 is a bottom elevational view showing a reinforcement ring layer and abrasive disks employed with the first embodiment pad assembly.
Figure 4:
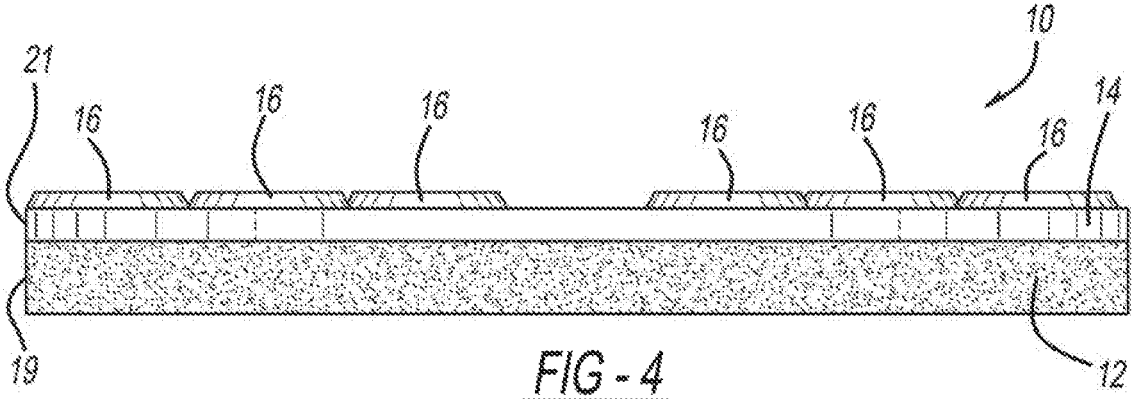
FIG. 4 is a side elevational view showing the first embodiment pad assembly.
Figure 5:
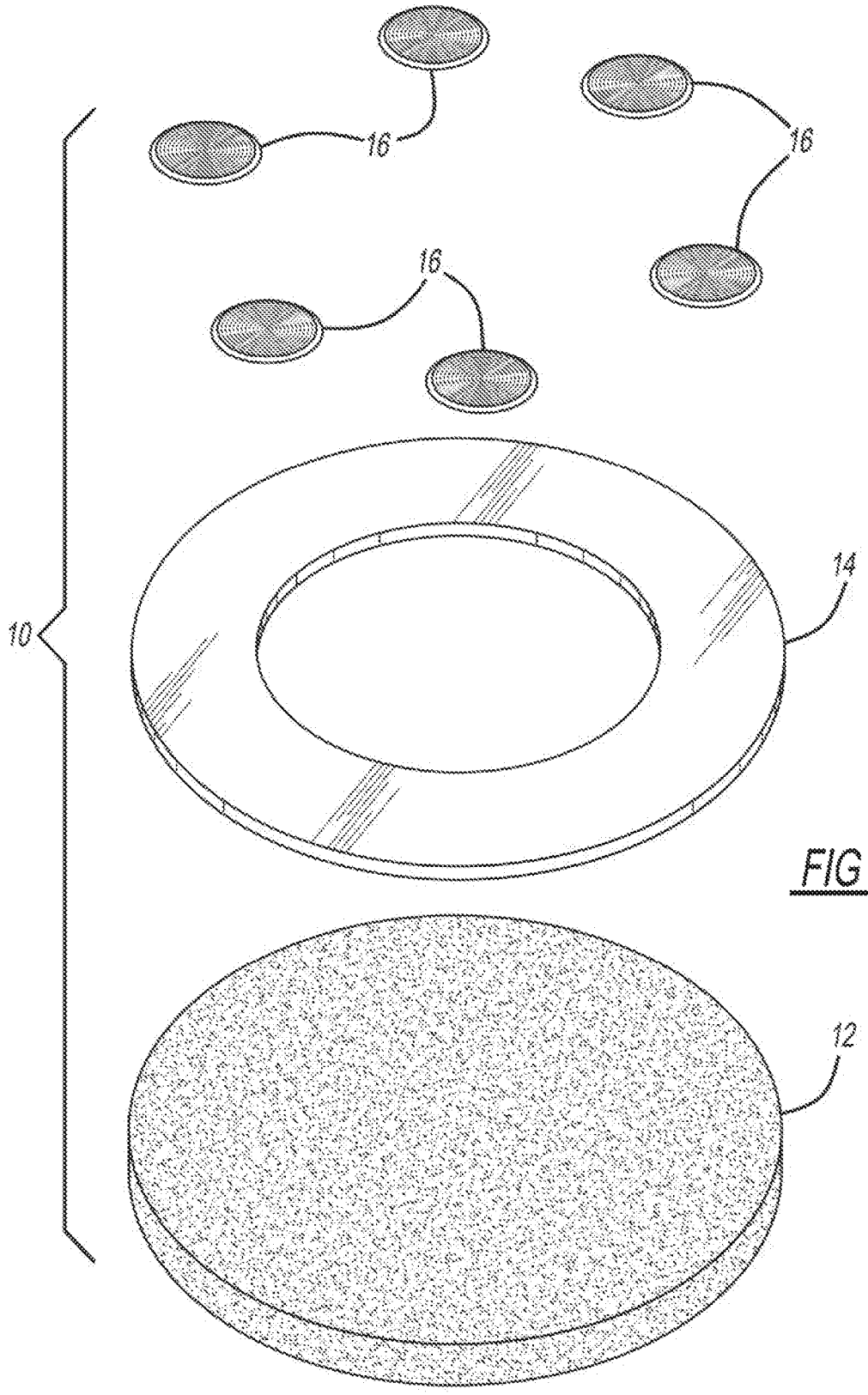
FIG. 5 is an exploded bottom perspective view showing the first embodiment pad assembly.

FIG. 3 is a bottom view of reinforcement ring 14 with the plurality of abrasive tools or disks 16 secured thereto. FIG. 4 is a side view of polishing pad 10 of FIG. 1. As shown, reinforcement ring 14 is secured to base pad 12. The plurality of abrasive tools or disks 16 are secured to reinforcement ring 14. FIG. 5 is an exploded view of polishing pad of FIG. 1, showing base pad 12, reinforcement ring 14 and the plurality of abrasive tools or disks 16.

As shown in FIGS. 6A-6E, many different types of abrasive tools or disks 16 and 16*a-c* could be secured to reinforcement ring 14. As can be viewed in FIG. 6B, tool or disk 16*a* has a floor-contacting and abrasive pattern 30 consisting of multiple concentric circles 32, preferably at least 3 and more preferably 4, intersected by straight radial spokes 34 and 36. Spokes 34 linearly extend from an innermost circle to an outermost and peripheral tapered circle while spokes 36 are radially shorter and linearly extend from an intermediate circle to the peripheral circle. The spokes are equally spaced about the entire disk. Spokes 34 and 36 are aligned with a centerline 41. Circles 32 and spokes 34 and 36 are preferably grooves or channels molded below a generally flat nominal surface 38 which contacts against the floor during use. A center 40 is solid and without a hole therein, although in an alternate arrangement a through hole may be provided at the center but some of the functional advantages may not be fully achieved.

Figure 6A:
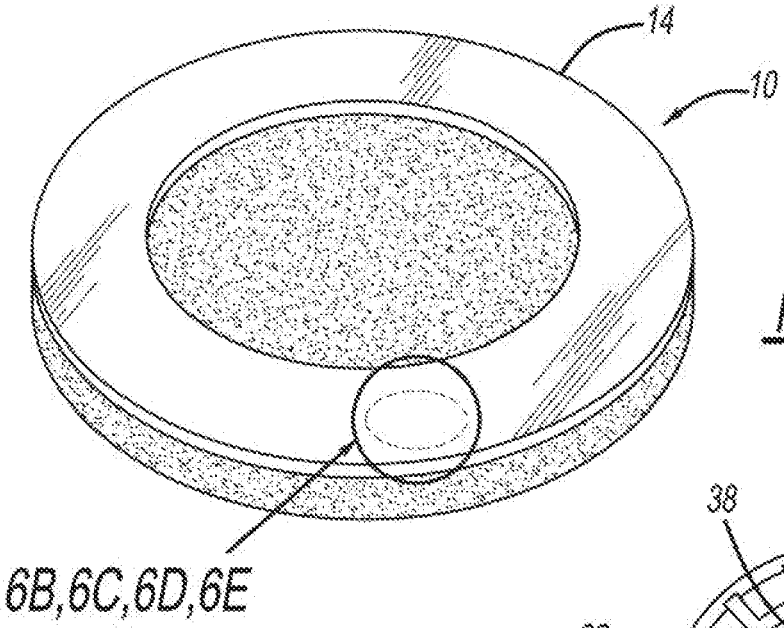
FIG. 6A is a bottom perspective view showing the ring layer and pad employed in the first embodiment pad assembly.
Figure 6B:
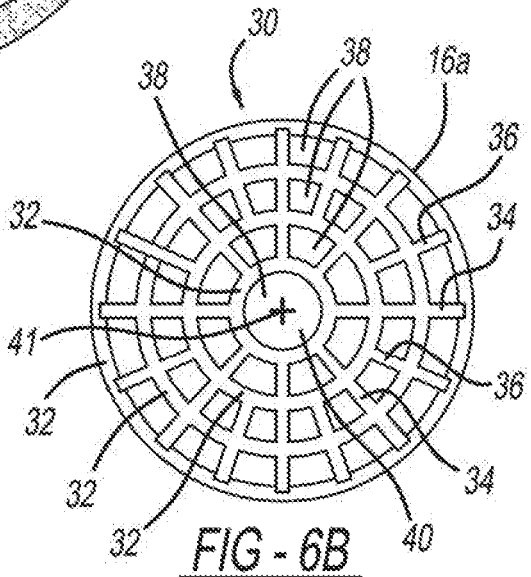
FIG. 6B is a bottom elevational view showing a disk pattern employed with the first embodiment pad assembly.
Figure 6C:
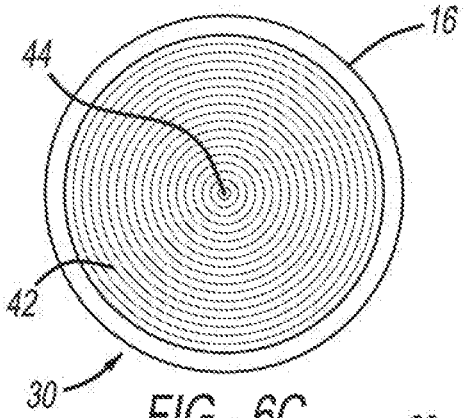
FIG. 6C is a bottom elevational view showing another disk pattern employed with the first embodiment pad assembly.

FIG. 6C shows another exemplary tool or disk 16. This embodiment employs at least 10, and more preferably at least 30 concentrically circular grooves 42 between which are raised circular ridges defining a generally flat and planar nominal surface which contacts against the building floor when in use. A center 44 is solid and without a through hole, although it is alternately envisioned that a small through hole may be provided but some of the functional advantages may not be fully achieved.

Figure 6D:
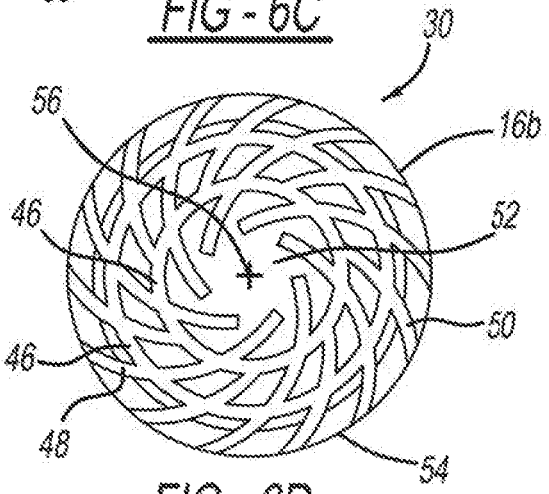
FIG. 6D is a bottom elevational view showing another disk pattern employed with the first embodiment pad assembly.

FIG. 6D illustrates yet another embodiment of tool or disk 16*b*. This exemplary embodiment provides multiple circular grooves 46, arranged in a concentric pattern. At least 4 and more preferably 7 arcuately curved spokes 48, of an elongated nature, and at least 4 and more preferably 7, arcuately curved shortened spokes 50 intersect circular grooves 46. Spokes 48 and 50 are channels or grooves which outwardly radiate between a solid center 52 and a circular tapered periphery 54 of disk 16*b*. Innermost ends of spokes 48 and 50 are offset from a disk centerline 56. Alternately, a central through hole may be provided at center 52 but some of the functional benefits may not be fully realized.

Figure 6E:
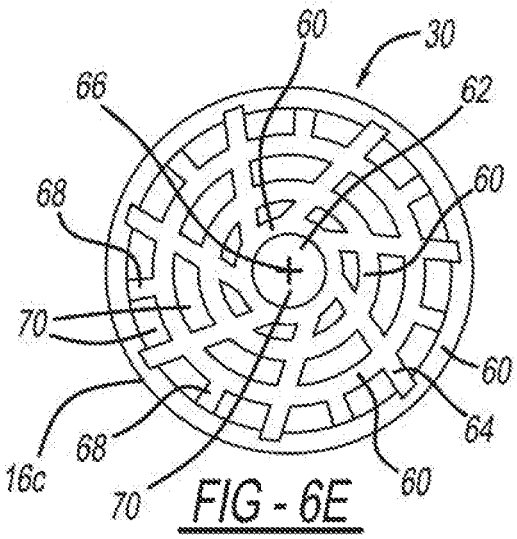
FIG. 6E is a bottom elevational view showing another disk pattern employed with the first embodiment pad assembly.

Still another configuration is shown in FIG. 6E. Multiple circular grooves 60 are concentrically arranged above a solid center 62. At least 3 and more preferably 7 linearly elongated spokes 64 outwardly radiate from an innermost circular groove to a peripheral tapered circular groove, however, an innermost end of each spoke 64 is offset from a centerline 66. Additional shortened spokes 68 outwardly radiate between outermost groove and the next groove internal therefrom. The shortened spokes 68 are radially aligned with disk centerline 66.

These different disk patterns of FIGS. 6B through 6E are expected to perform differently depending upon whether polishing or grinding use is desired and also depending upon the floor materials and characteristics to be worked upon by the present pad assembly 10. For example, a liquid polishing or grinding solution is typically employed between the disks and the floor. Therefore, the angle, size, spacing and curvature of the channels or grooves somewhat dictates the flow of the solution and abrasive action between the disks and floor when the pad assembly is being rotated by the powered machine. Moreover, these pattern characteristics also assist the pads in riding over, or alternately abrading, floor surface imperfections such as localized bumps or ridges therein. It should also be appreciated that polishing or grinding pastes or powders may alternately be employed instead of liquid solutions. Additionally, any of the patterns of FIGS. 6B-6E may have an offset angle $\alpha$ or have a parallel planar relationship β, or may be used with any of the embodiments disclosed herein. Notwithstanding, these pattern shapes also have an ornamental aspect.

Figure 7:
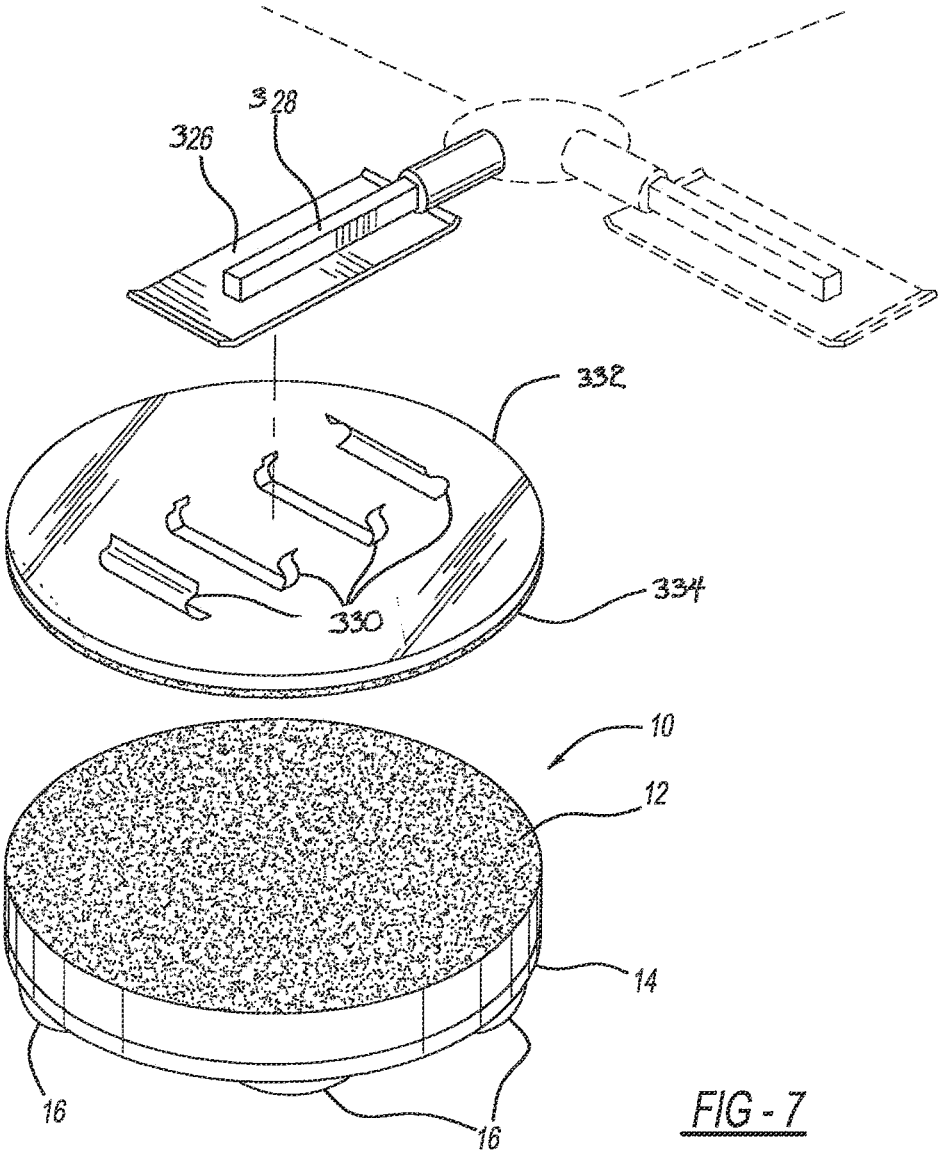
FIG. 7 is a partially exploded top perspective view showing the first embodiment pad assembly and a powered machine.
Figure 8:
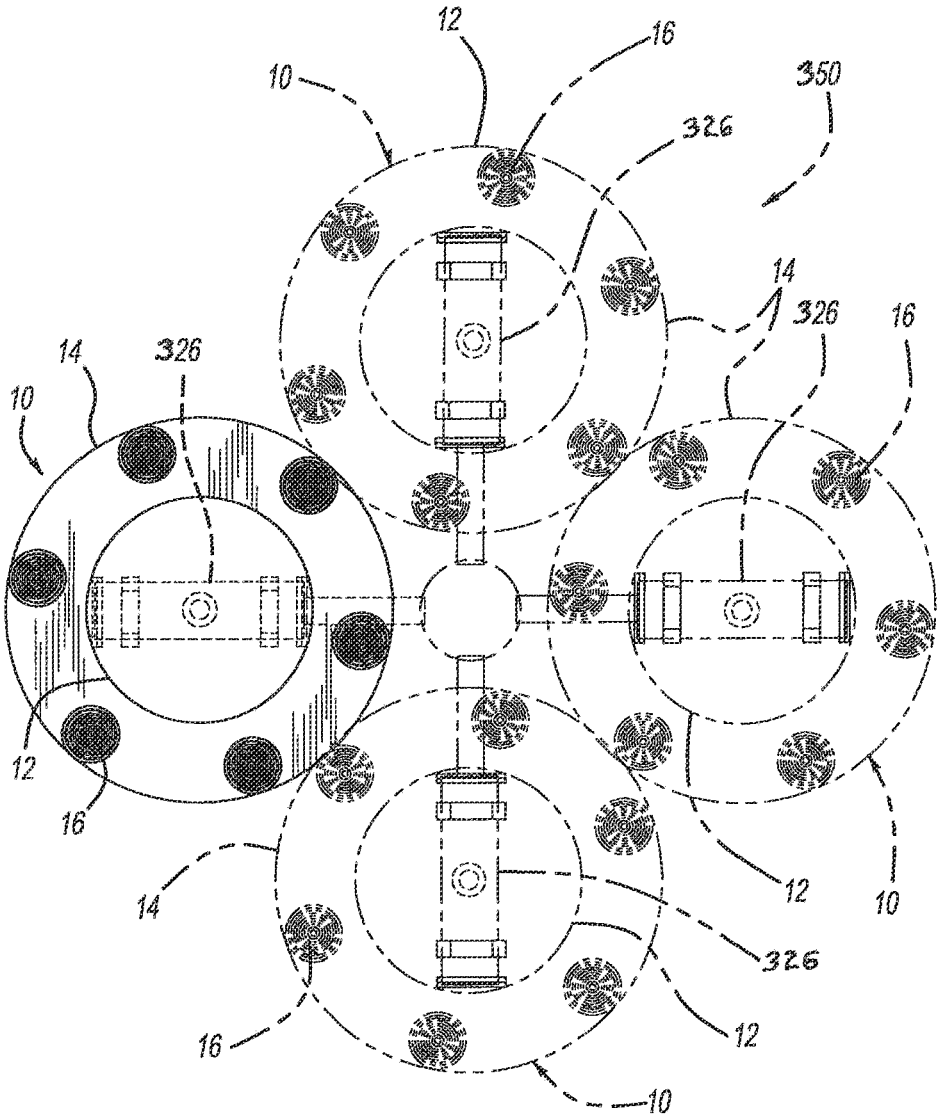
FIG. 8 is a diagrammatic bottom elevational view showing the first embodiment pad assembly and powered machine.

FIG. 7 shows an innovative way that polishing pad 10 could be secured to a paddle 326 of a rotating arm 328 of an electric motor powered floor polishing or grinding machine 350. A hard rubber or plastic disk 332 includes a plurality of clips 330 for releasably securing to paddle 326. A panel 334 of hook-and-loop-type hooks (e.g. Velcro®) may be secured to the bottom of disk 332 and can be removably secured to the fibrous base pad 12. FIG. 8 is a bottom view of machine 350, wherein a plurality of polishing pads 10 would be secured for rotation about a center axis. Alternate powered machines may be used to rotate pad assembly 10 such as those disclosed in the Background section hereinabove.

Other ways could be used to secure polishing pad 10 to machine 350. In use, reinforcement ring 14 provides a more rigid surface to which abrasive tools or disks 16 are secured than base pad 12 would provide alone. The thickness and material of reinforcement ring 14 can be varied and selected for particular applications. For example, a more rigid reinforcement ring 14 will have more of a tendency to grind a surface (such as a concrete floor) toward a planar surface, while a more flexible reinforcement ring 14 will have more of a tendency to follow contours in the surface while polishing or grinding it.

Figure 9:
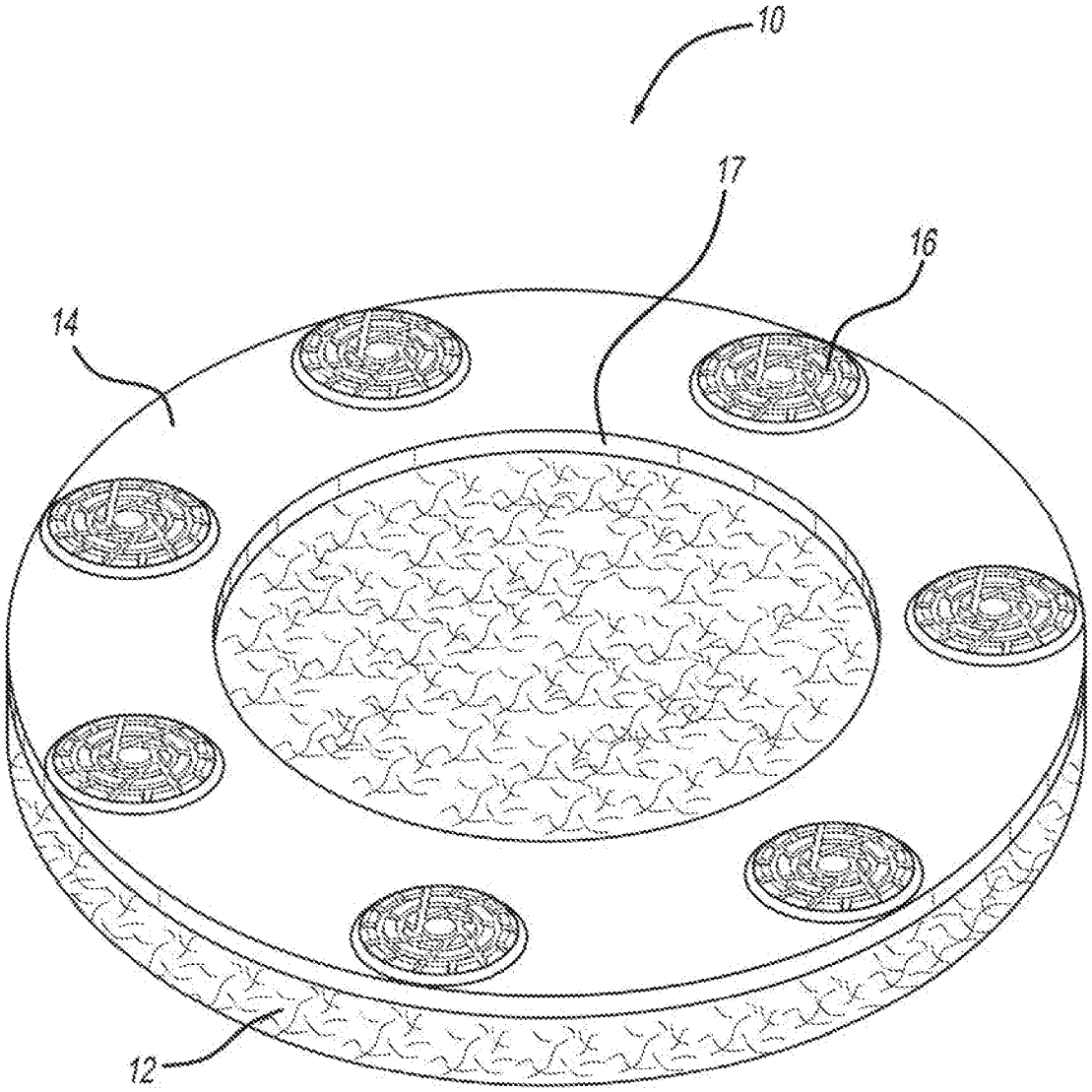
FIG. 9 is a bottom elevational view showing a second embodiment of the pad assembly.
Figure 10:
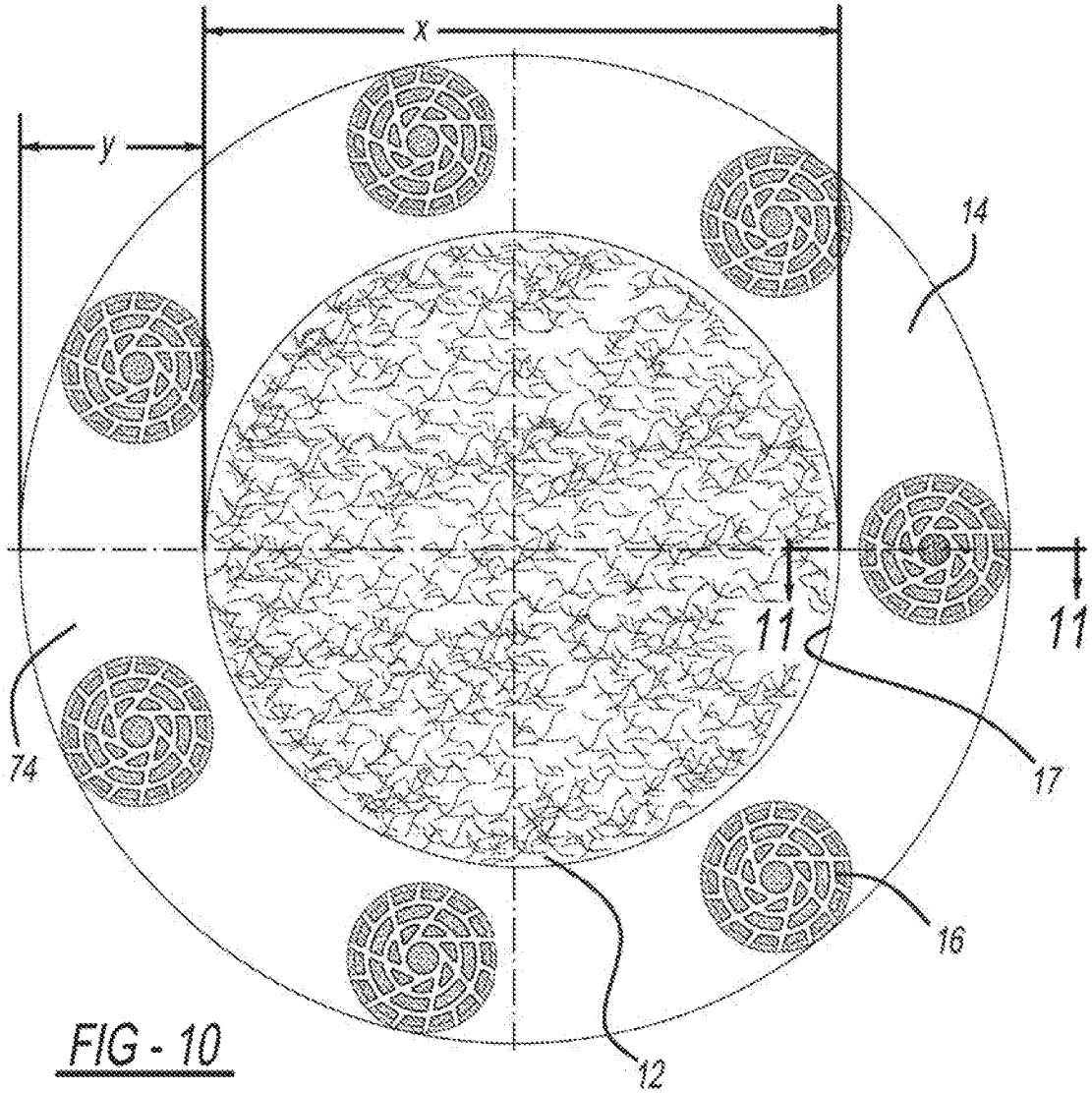
FIG. 10 is a bottom elevational view showing the second embodiment pad assembly.
Figure 11:
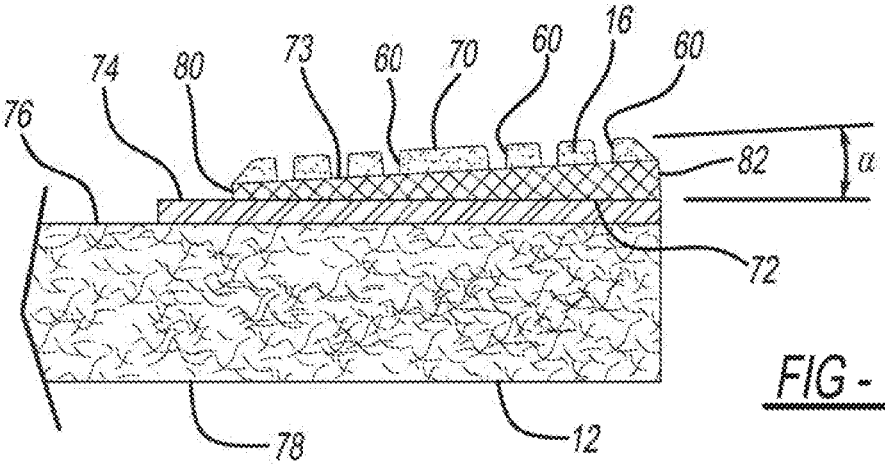
FIG. 11 is a cross-sectional view, taken along line 11-11 of FIG. 10, showing the second embodiment pad assembly.

Reference should now be made to FIGS. 9-11 for another embodiment of pad assembly 10. A fibrous circular pad 12 and elastomeric or polymeric reinforcement ring 14 are essentially as provided hereinabove. It is noteworthy that inner edge 17 defining the hole of ring 14 has a diameter or linear dimension x which is larger than a linear dimension y of a solid section of ring 14 which is adjacent to one side of the hole. More preferably, hole dimension x is at least twice as large as ring dimension y and more preferably, dimension x is 9 inches. The hole relationship of x>y is expected to improve floor contact by the fibrous central portion of pad 12 within the hole defined by internal edge 17 of ring 14. At least 4 and more preferably 7 tools or disks 16 are adhesively attached to a lower surface of reinforcement ring or layer 14. Each disk has a diameter of 1-2.5 inches and more preferably 2 inches. This disk size and quantity on pad assembly 10 is ideally suited for floor-grinding and provides improved floor contact as compared to prior constructions which used 3 inch diameter disks and were arranged in a quantity of less than 7 per pad assembly. Notwithstanding, the present dimensional relationships and the arrangement and quantity of disks about the ring also have ornamental aspects.

Each disk 16 of this embodiment has an offset angle α between a nominal generally flat, floor-contacting surface 70 of disk pattern 30 and an upper base surface 72 (upper when in the functional position with surface 70 against the floor). Angle α is at least 2 degrees, more preferably at least 2-10 degrees, or 4 degrees, and even more preferably 4-10 degrees. Surface 70 is preferably parallel to a nominal surface 73 defined by the most depressed portions of the circular and radial grooves. Upper surface 72 of the base of each disk is preferably parallel to the mating lower surface 74 of reinforcement ring 14 and also both lower and upper surfaces 76 and 78, respectively, of pad 12. An apex of angle α and thinnest portion is preferably adjacent an inboard edge 80 of each disc while the thickest portion of each disk 16 is preferably at an outboard edge 82. While each disk 16 is shown as being of the FIG. 6E pattern, it should be appreciated that it is alternately envisioned that the other disk patterns disclosed hereinabove may also be employed with this embodiment although all of the functional benefits may or may not be fully realized.

Figure 12:
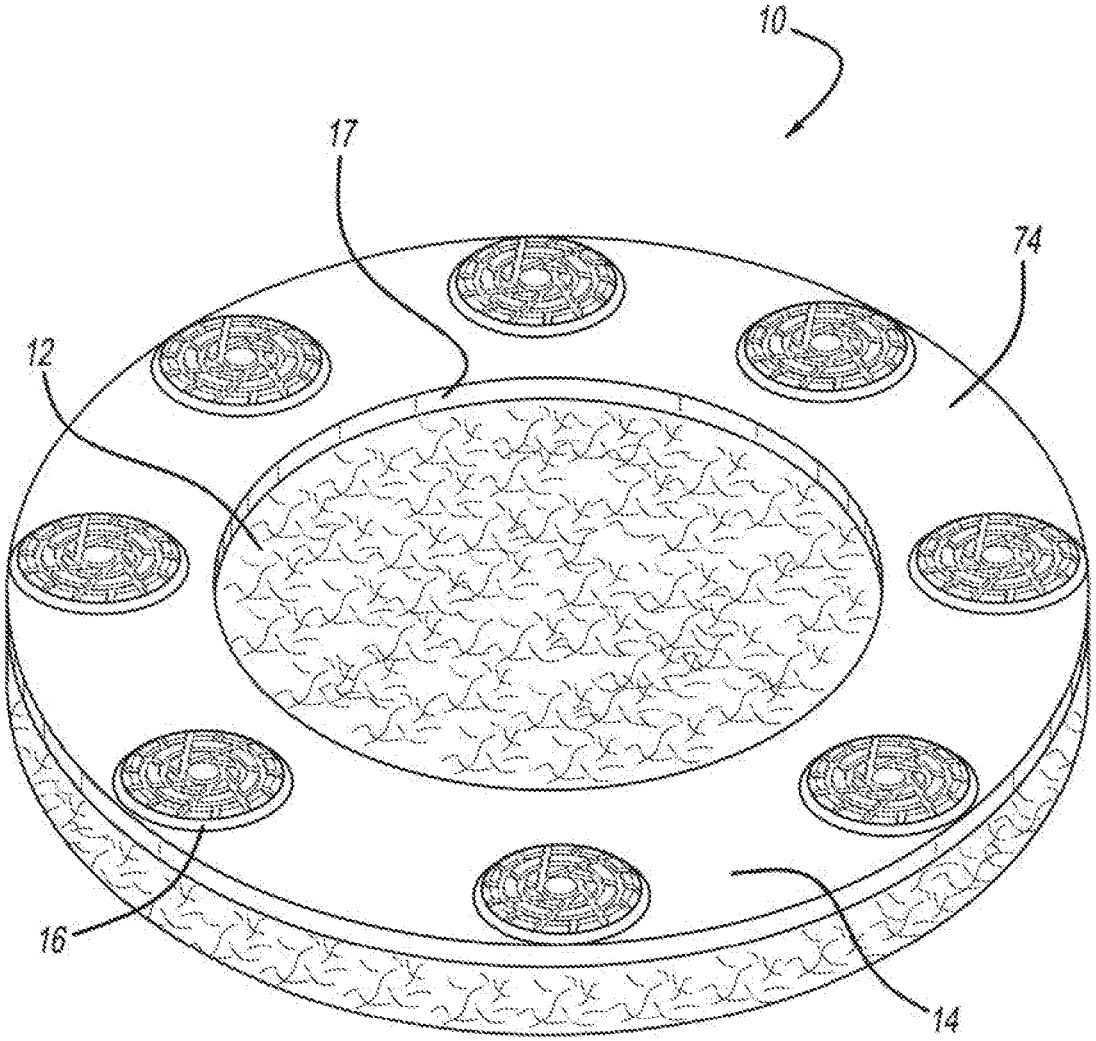
FIG. 12 is a bottom perspective view showing a third embodiment of the pad assembly.
Figure 13:
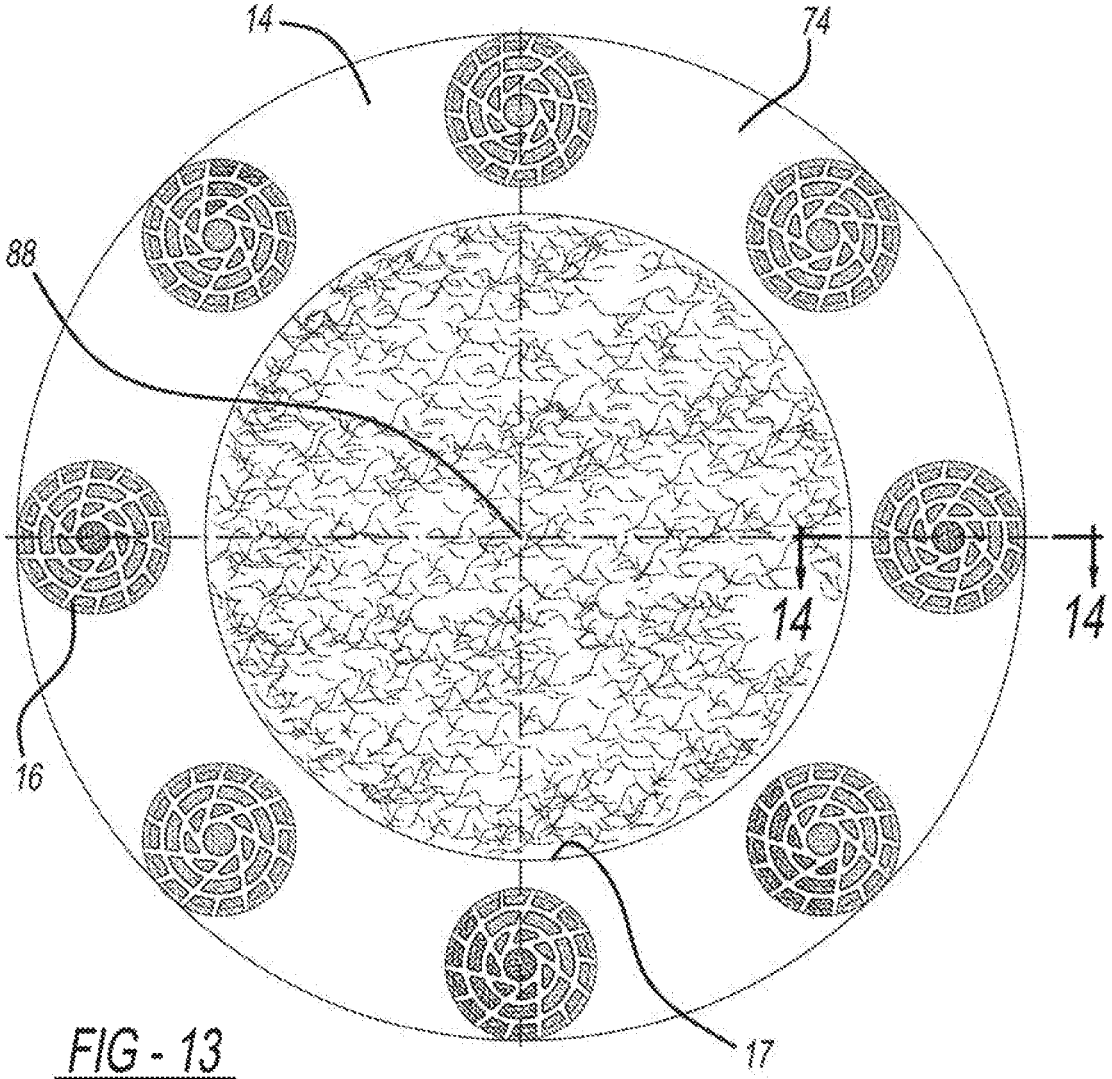
FIG. 13 is a bottom elevational view showing the third embodiment pad assembly.
Figure 14:
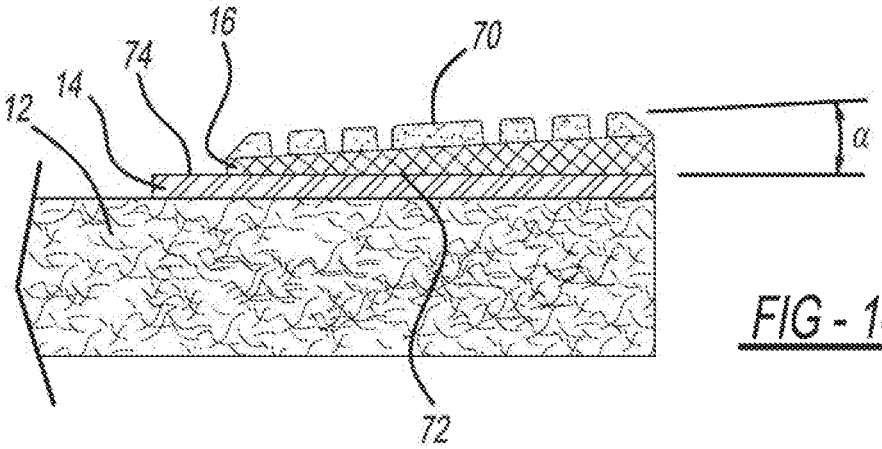
FIG. 14 is a cross-sectional view, taken along line 14-14 of FIG. 13, showing the third embodiment pad assembly.
Figure 15:
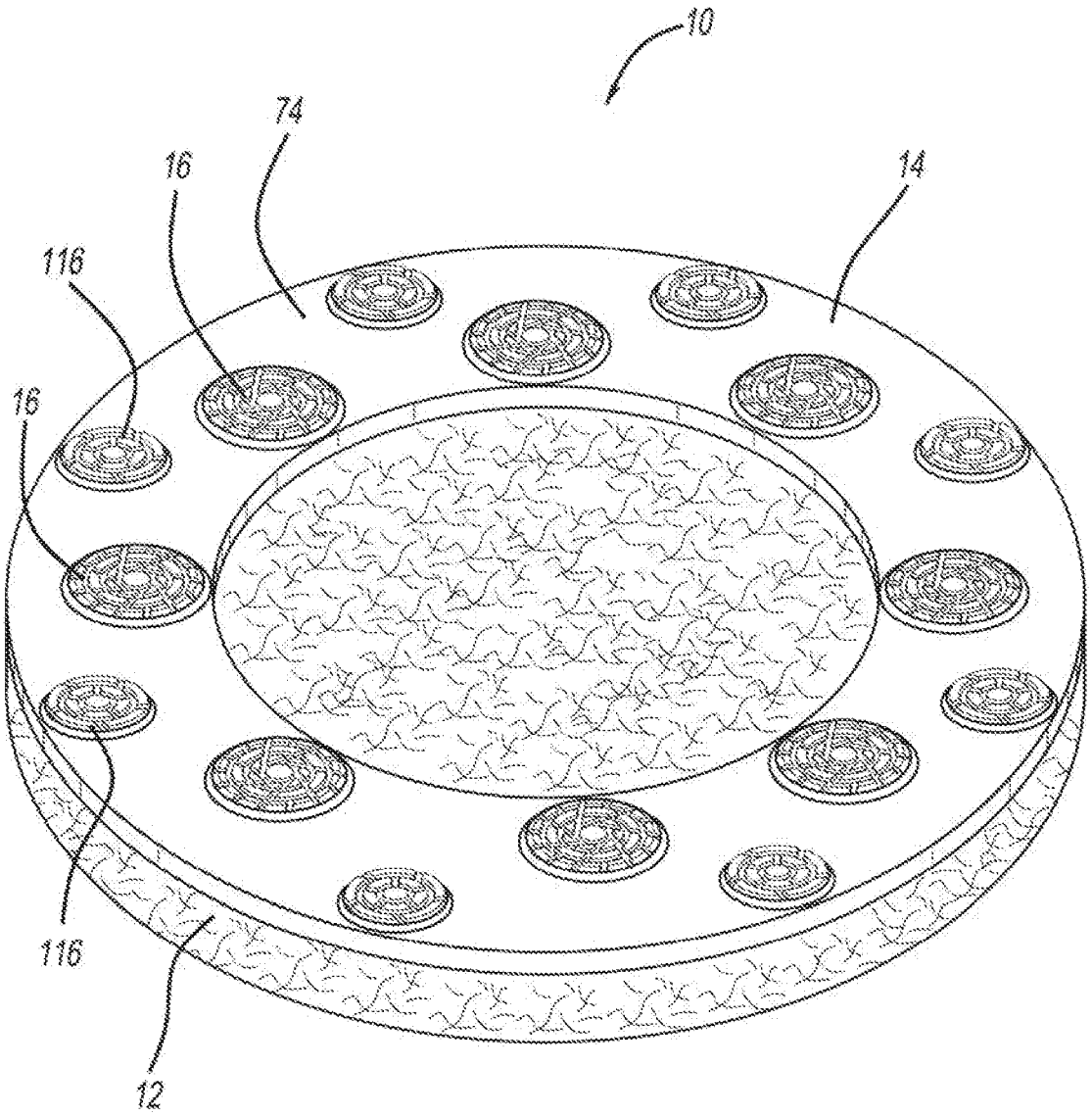
FIG. 15 is a bottom perspective view showing a fourth embodiment of the pad assembly.
Figure 16:
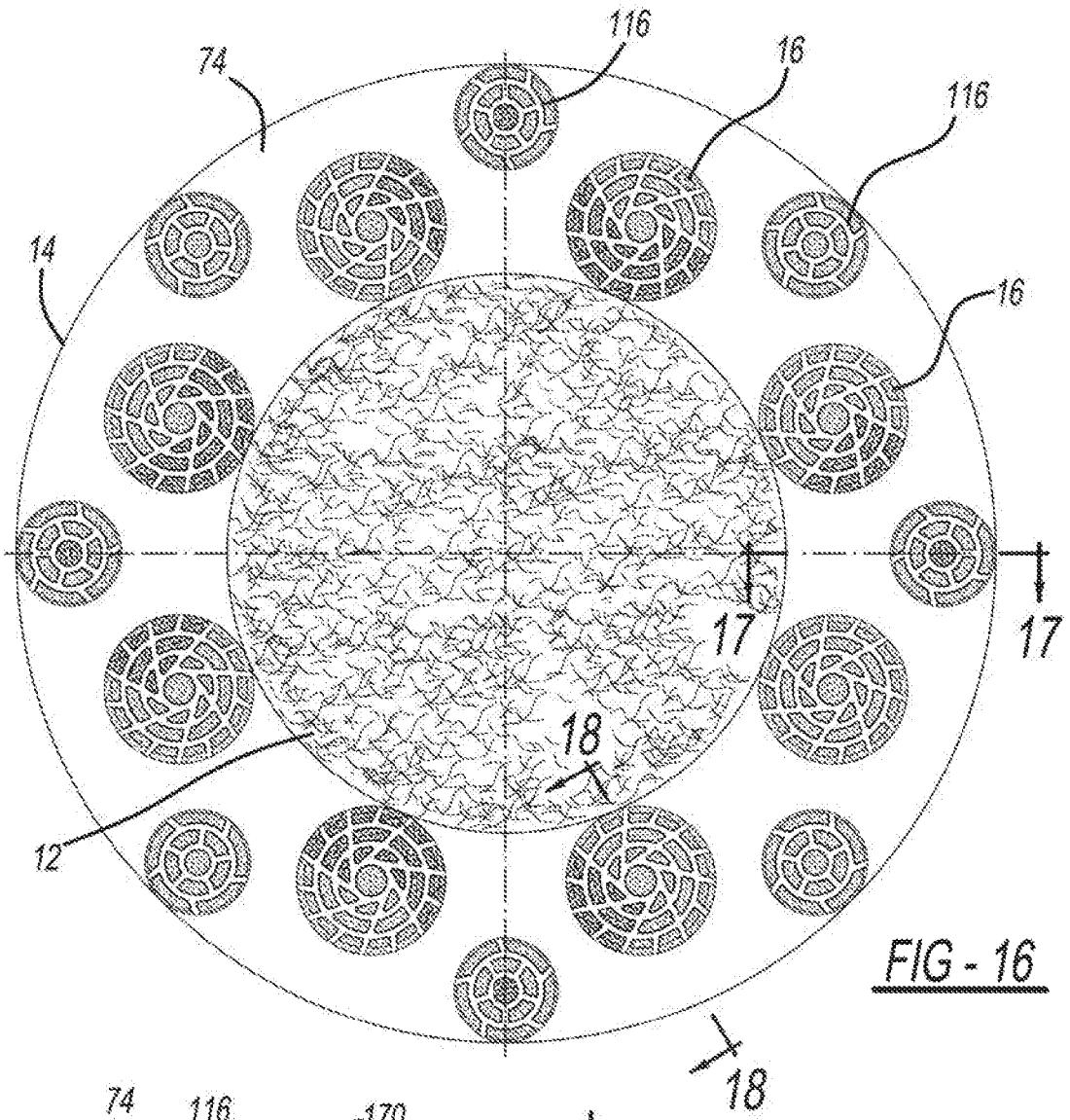
FIG. 16 is a bottom elevational view showing the fourth embodiment pad assembly.
Figure 17:
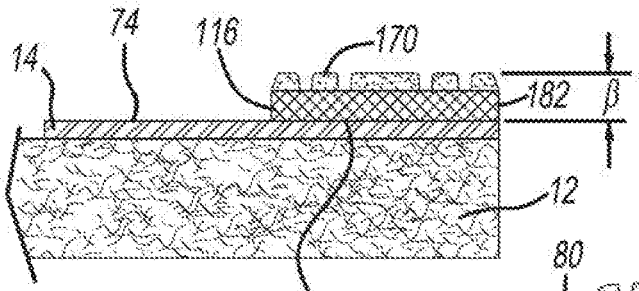
FIG. 17 is a cross-sectional view, taken along line 17-17 of FIG. 16, showing the fourth embodiment pad assembly.
Figure 18:
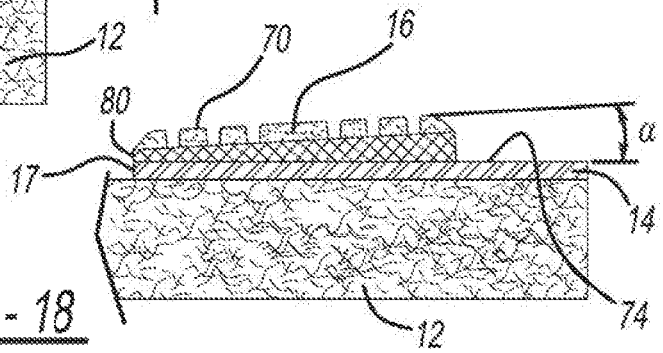
FIG. 18 is a cross-sectional view, taken along line 18-18 of FIG. 16, showing the fourth embodiment pad assembly.

FIGS. 12-14 show another embodiment of pad assembly 10. This configuration is the same as the embodiment of FIG. 9 except that there are 8 of the disks 16 mounted to lower surface 74 of reinforcement ring 14. Disks 16 are all equilaterally spaced apart from each other and are also equally spaced apart from a centerline 88 of pad 12. This configuration is ideally suited for a final polishing operation although, it should also be appreciated that there are ornamental aspects to this embodiment as well.

Referring now to FIGS. 15-18, in a further embodiment of pad assembly 10, fibrous pad 12 is essentially the same as that in the prior embodiments. A circular reinforcement ring or layer 14 is like that previously described with hole dimension x being greater than an adjacent solid side dimension y of ring 14. However, hole dimension x is at least 8 inches, preferably exactly 8 inches, while y dimension is at least 6 inches, and more preferably exactly 6 inches.

Two sets of tools or disks 16 and 116 are adhesively attached to lower surface 74 of reinforcement ring 14. The disk sets have differing characteristics from each other, such as size, pattern, angles, grit coarseness, material composition, or the like. Furthermore, the first set of disks 16 are radially offset from and circumferentially alternating with the second set of disks 116.

Inner first set of disks 16 each have a diameter of 2 inches and an angle α of 2-10 degrees, more preferably at least 4 degrees. An innermost edge 80 of each disc 16 is generally aligned with inner edge 17 of ring 14. Conversely, each of the outer second set of disks has its nominal floor-contacting surface or plane 170 at a dimensional relationship or zero angle β generally parallel to a top surface 172 of its base which is also parallel to lower surface 74 of ring 14 and the top and bottom surfaces of fibrous pad 12. An outermost edge 182 of each of the second disks 116 is generally aligned with the peripheral surfaces of ring 14 and fibrous pad 12. Moreover, each second disk 116 has a diameter less than that of first disk 16, and more preferably 1.5 inches.

The angle α of disks 16 (of both this and the other offset angled embodiments disclosed herein) compensates for the inherent uneven wear that occurs when the powered machine rotates pad assembly 10 while the machine also tends to provide more downward force closer to the centerline than at the peripheral portions of the pad assembly. This is expected to improve longevity and polishing/grinding consistency when in use. Furthermore, the disk and ring configurations of the FIG. 15-18 embodiment are ideally suited for a pre-polishing step between grinding and polishing, although certain ornamental aspects of this construction are also achieved.

Figure 19:
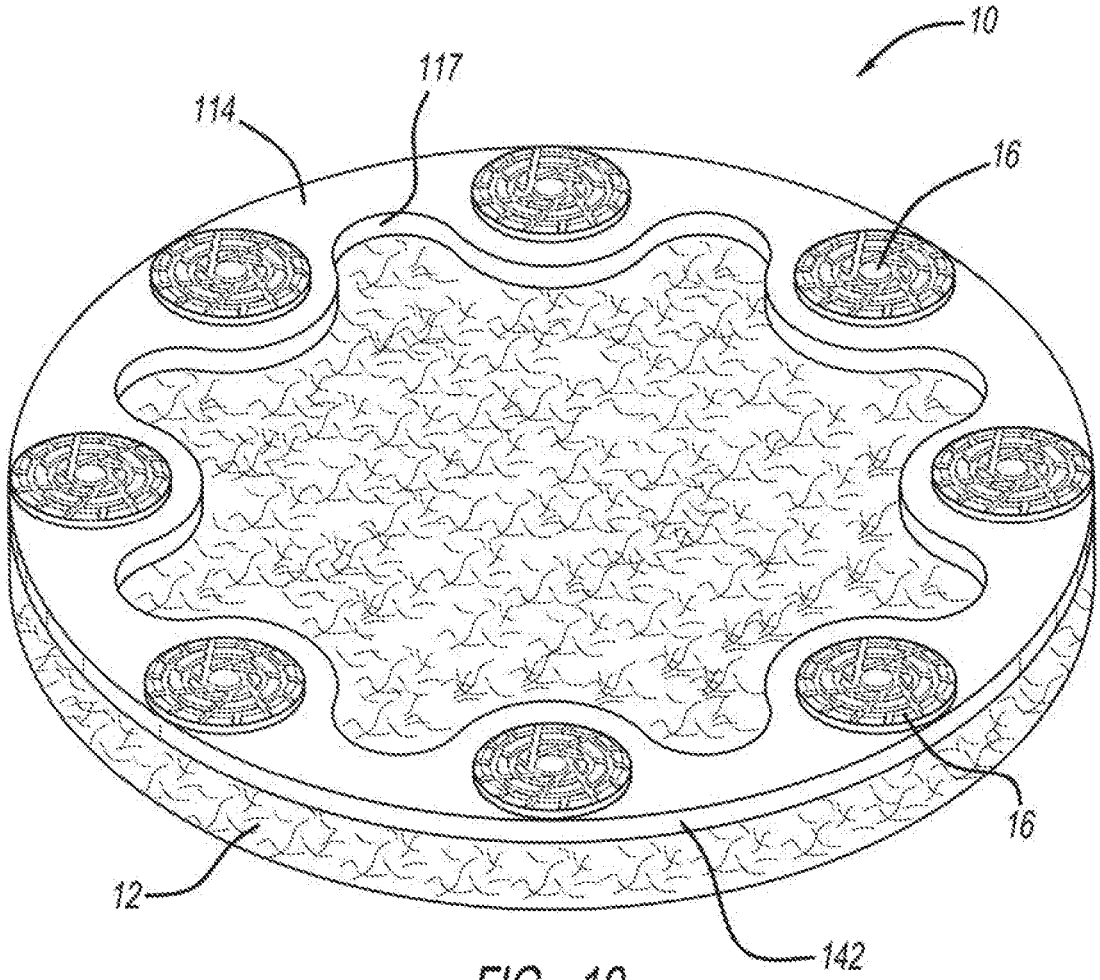
FIG. 19 is a bottom perspective view showing a fifth embodiment of the pad assembly.
Figure 21:
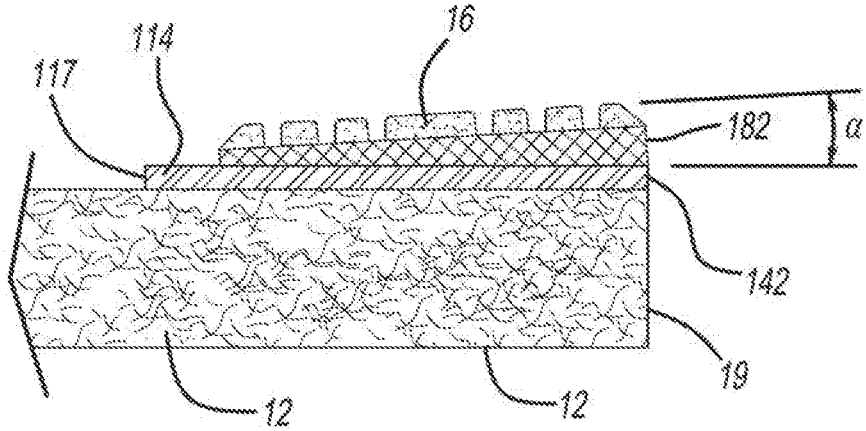
FIG. 21 is a cross-sectional view, taken along line 21-21 of FIG. 20, showing the fifth embodiment pad assembly.
Figure 20:
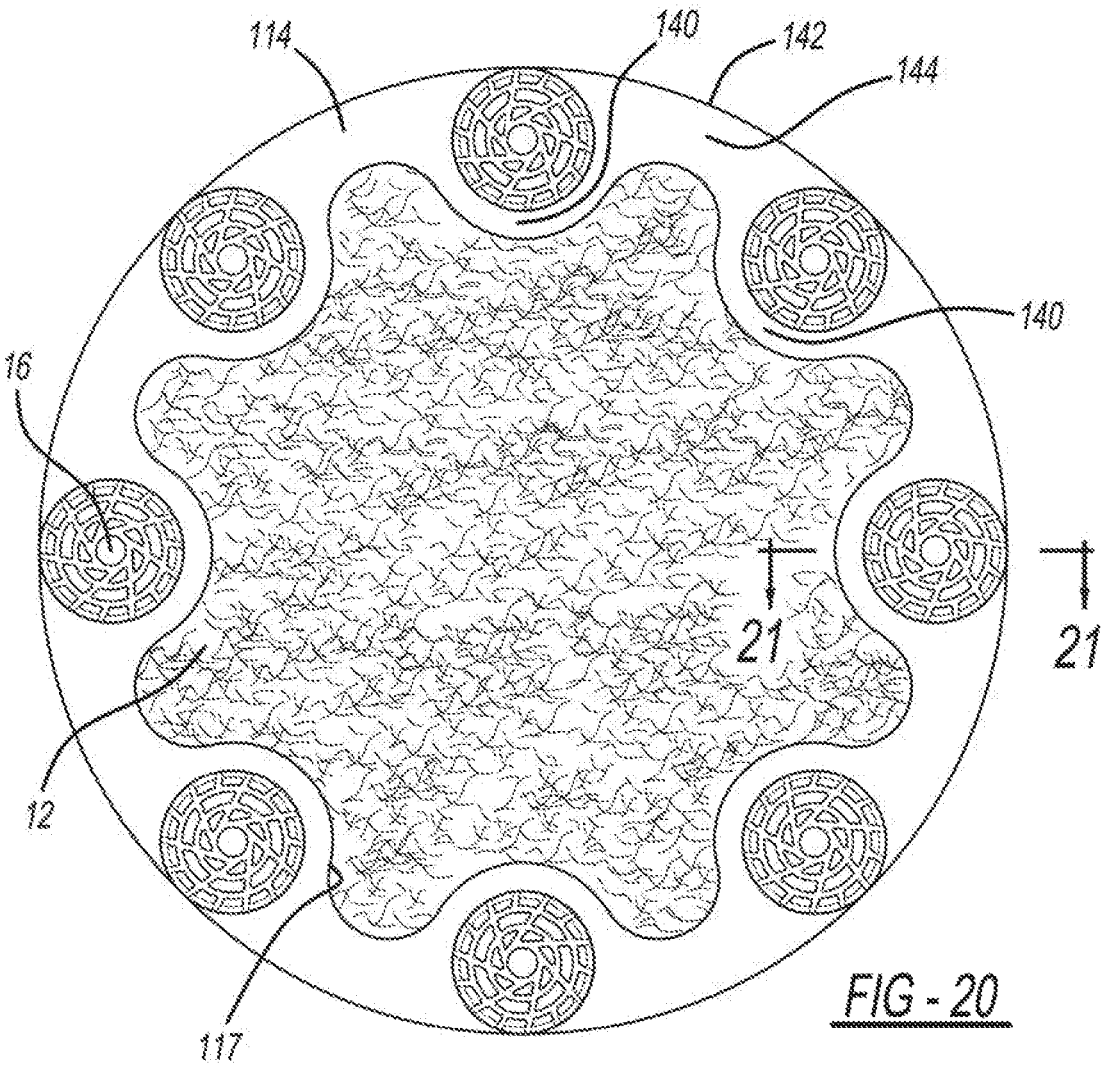
FIG. 20 is a bottom elevational view showing the fifth embodiment pad assembly.
Figure 22:
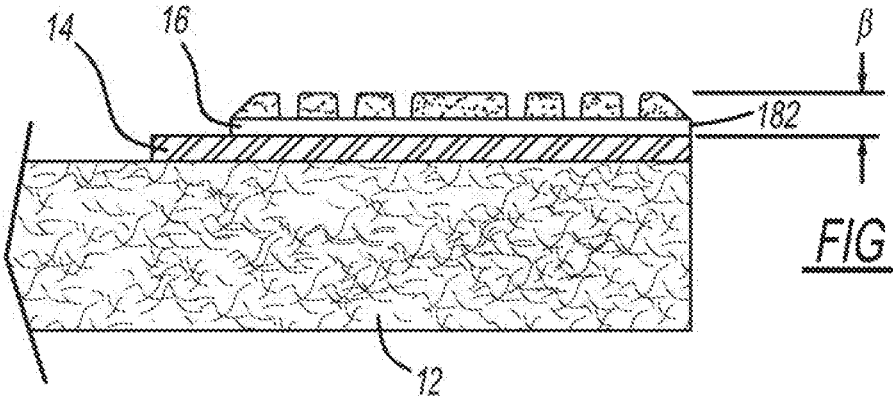
FIG. 22 is a cross-sectional view, like that of FIG. 21, showing a sixth embodiment of the pad assembly.

Reference is now made to FIGS. 19-21. This exemplary embodiment employs a fibrous pad 12 and disks 16 like that of FIG. 13. A reinforcement ring or layer 114, however, has a wavy or undulating inner edge 117 defining a hole therein to expose a central portion of fibrous pad 12. Ring 114 has peaks 140, with a greater radial distance between an outer peripheral edge 142 and inner edge 117 of ring 114. Spaced between adjacent peaks 140 are valleys 144 where the radial dimension or thickness is less between outer peripheral edge 142 and inner edge 117 of ring 114. This wavy or undulating ring shape maximizes the center hole area, and thereby floor-to-fibrous pad contact. The hole is essentially surrounded by the abrading tools or disks 16. Nevertheless, there are also ornamental aspects to this design. While the bottom or working disk nominal surface-to-ring and pad angle α is preferably offset angled by 2-10 degrees, and more preferably at least 4 degrees, (see FIG. 21), it is alternately envisioned in FIG. 22 that such could be given a parallel planar relationship of β instead although some of the functional advantages may not be realized. Both of the FIGS. 21 and 22 configurations have the outermost peripheral edge 182 of each disk 16 substantially aligned with peripheral edges 142 of ring 114 and 146 of pad 12.

While various embodiments have been disclosed, it should be appreciated that additional variations of the pad assembly are also envisioned. For example, while preferred dimensions have been disclosed hereinabove, it should alternately be appreciated that other dimensions may be employed; for example a peripheral pad diameter of at least 10 inches may be employed and disk diameters of 0.5-2.5 inches may also be employed. Moreover, circular peripheral shapes for the pad, reinforcement ring and disks are preferred, however, other arcuate or even generally polygonal peripheral shapes may be used although certain of the present advantages may not be fully realized. While certain materials have been disclosed it should be appreciated that alternate materials may be used although all of the present advantages may not be fully achieved. It is also noteworthy that any of the preceding features may be interchanged and intermixed with any of the others; by way of example and not limitation, any of the disclosed reinforcement ring shapes and/or sizes may be employed with or without angular disks, with any of the aforementioned disk patterns and/or with any of the disk-to-disk positioning. Accordingly, any and/or all of the dependent claims may depend from all of their preceding claims and may be combined together in any combination. By way of further example, any of the previously disclosed disk patterns may be employed with or without offset angular disk surfaces and/or with any of the disk-to-disk positioning. Variations are not to be regarded as a departure from the present disclosure, and all such modifications are entitled to be included within the scope and sprit of the present invention.

The invention claimed is:

1. A pad assembly comprising:

a fibrous pad comprising an upper surface, a floor-facing lower surface, and a peripheral surface;

a reinforcement layer; and abrasive tools, wherein the reinforcement layer is attached to the floor-facing lower surface of the fibrous pad, the reinforcement layer including an internal edge defining a hole therethrough;

wherein the abrasive tools are attached to a floor-facing surface of the reinforcement layer;

wherein a central area of the fibrous pad is exposed through the hole of the reinforcement layer;

wherein the abrasive tools are disks; and wherein each of the disks has a floor-contacting nominal surface which is angularly offset by at least two degrees relative to the floor-facing surface of the reinforcement layer.

2. The pad assembly according to claim 1, wherein the fibrous pad is flexible.

3. The pad assembly according to claim 1, wherein the reinforcement layer is elastomeric or polymeric.

4. The pad assembly according to claim 1, wherein the reinforcement layer has a thickness up to 0.125 inches.

5. The pad assembly according to claim 1, wherein the fibrous pad includes diamond abrasive particles and has thickness of about 1 inch.

6. The pad assembly according to claim 1, wherein a thickness of the reinforcement layer is less than a thickness of the fibrous pad.

7. The pad assembly according to claim 1, wherein the reinforcement layer has a wavy or undulating inner edge relative to a circular outer peripheral edge of the reinforcement layer.

8. The pad assembly according to claim 1, wherein the inner edge of the reinforcement layer has peaks with less radial distance from a center of the floor-facing surface of the fibrous pad than valleys formed between adjacent peaks.

9. The pad assembly according to claim 1, wherein the inner edge of the reinforcement layer is circular.

10. The pad assembly according to claim 1, wherein a periphery of the reinforcement layer is circular.

11. The pad assembly according to claim 1, wherein the abrasive tools are adhesively bonded to the reinforcement layer and substantially equally spaced away from a centerline of the fibrous pad.

12. The pad assembly according to claim 1, wherein the abrasive tools are disks having a peripheral diameter of about 0.5-2.5 inches.

13. The pad assembly according to claim 1, wherein the abrasive tools are disks, the disks comprising a first set of disks and a second set of disks coupled to the fibrous pad, each disk of the first set of disks including a floor-contacting nominal surface; and wherein each disk of the second set of disks includes a floor-contacting nominal surface; and wherein a characteristic of the second set of disks are different from that of the first set of disks.

* * * * *